US009446496B2

(12) United States Patent
Chen

(10) Patent No.: US 9,446,496 B2
(45) Date of Patent: Sep. 20, 2016

(54) ABRASIVE BELT POLISHING FINISHER

(71) Applicant: Qiyue Chen, Taizhou (CN)

(72) Inventor: Qiyue Chen, Taizhou (CN)

(73) Assignee: Taizhou Federal Robot Technology Co., Ltd, Taizhou (CN)

( * ) Notice: Subject to any disclaimer, the term of this patent is extended or adjusted under 35 U.S.C. 154(b) by 235 days.

(21) Appl. No.: 14/320,623

(22) Filed: Jun. 30, 2014

(65) Prior Publication Data

US 2015/0375357 A1 Dec. 31, 2015

(30) Foreign Application Priority Data

Jul. 2, 2013 (CN) ..... 2013 1 0277803
Apr. 17, 2014 (CN) ..... 2014 1 0153969

(51) Int. Cl.

| | |
|---|---|
| ***B24B 21/16*** | (2006.01) |
| ***B24B 21/12*** | (2006.01) |
| ***B24B 21/02*** | (2006.01) |
| ***B24B 21/00*** | (2006.01) |

(52) U.S. Cl.

CPC ..... *B24B 21/16* (2013.01); *B24B 21/002* (2013.01); *B24B 21/008* (2013.01); *B24B 21/02* (2013.01)

(58) Field of Classification Search

CPC ... B24B 21/00; B24B 21/002; B24B 21/004; B24B 21/008; B24B 21/02; B24B 21/08; B24B 21/12; B24B 21/14; B24B 21/16

USPC ..... 451/59, 296, 299, 303

See application file for complete search history.

(56) References Cited

U.S. PATENT DOCUMENTS

| | | | | |
|---|---|---|---|---|
| 1,844,165 | A * | 2/1932 | Kabelac | B24B 21/16 451/303 |
| 3,972,152 | A * | 8/1976 | Faure | B24B 21/00 451/303 |
| 6,527,629 | B1 * | 3/2003 | Sandvold | B24B 9/007 451/296 |
| 9,193,024 | B2 * | 11/2015 | Chen | B24B 21/008 |
| 2015/0044944 | A1 * | 2/2015 | Chen | B24B 21/008 451/1 |

FOREIGN PATENT DOCUMENTS

| | | |
|---|---|---|
| CN | 201645305 U | 11/2010 |
| CN | 102303275 A | 1/2012 |
| CN | 202540094 U | 11/2012 |

* cited by examiner

*Primary Examiner* — Eileen Morgan

(74) *Attorney, Agent, or Firm* — Minder Law Group; Willy H. Wong

(57) ABSTRACT

The invention discloses an abrasive belt polishing finisher in the field of mechanical technology, which addresses inconvenient operation of the existing polishing finishers. The abrasive belt polishing finisher includes a motor and a connection support. The central section of the connection support is fixedly connected with the output shaft of the motor. Several self-rotable connection support finishing wheels are provided around the connection support. The curve surface of the rim of each of the support finishing wheels has a different curvature. Each connection support finishing wheel is distributed on the same circle centered on the output shaft of the motor. The connection support is driven by the motor into rotation to press and position one of the connection support finishing wheels against the back of the abrasive belt in the polishing finisher. The abrasive belt polishing finisher could satisfy continuous polishing treatment for different curved surfaces.

18 Claims, 13 Drawing Sheets

ABRASIVE BELT POLISHING FINISHER

BACKGROUND OF THE INVENTION

1. Field of Invention

The present invention pertains to the field of mechanical technology. The invention relates to an abrasive belt polishing finisher.

2. Related Art

The polishing finisher is a device particularly designed for finishing the surface of metallic products including steel, aluminum or copper or pipes. By using the polishing finisher, snow patters, drawing patterns, wave patterns, matter surfaces and mirror surfaces of different precisions could be produced, and deep scratches and slight scratches can be quickly repaired. The polishing finisher could be used for deburring and rounding and processing decorative metals, which will not result in any shadow, transition areas or uneven decorative surfaces during processing. As such, the polishing finisher is an important device for production of metallic products.

The abrasive belt polishing finisher grinds the surface of a work piece by means of the driving abrasive belt, which achieves flexible grinding and provides grinding, polishing and finishing effects. Compared with the polishing finishers in which the polishing and finishing treatment could be directly conducted by the finishing wheels, the abrasive belt polishing finisher is safer for processing and generates less noise and dust. The surface of the work piece has a higher quality after processing and a wider scope of application.

However, the conventional work pieces generally have several curved surfaces to be finished, and each of the curved surfaces has a curvature different from each other. When the conventional abrasive belt polishing finishers are used to finish the work pieces, finishing could not be efficiently carried out by using the flat abrasive belt. If other finishing wheels have to be removed or replaced, not only is the operation inconvenient, but also the finishing efficiency is low.

SUMMARY OF THE INVENTION

In order to address the problems existing in the prior art, it is an object of the invention to provide an abrasive belt polishing finisher which could perform continuous polishing treatment for a number of different curved surfaces.

The present invention provides an abrasive belt polishing finisher, comprising a finishing wheel transform mechanism. The transform mechanism includes a motor and a connection support. The central section of the connection support is fixedly connected with the output shaft of the motor. Several self-rotable support finishing wheels are provided around the connection support. The curve surface of the rim of each of the support finishing wheels has a different curvature. Each support finishing wheel is distributed on the same circle centered on the output shaft of the motor. The connection support is driven by the motor into rotation to press and position one of the support finishing wheels against the back of the abrasive belt in the polishing finisher.

When the finishing wheel transform mechanism of the abrasive belt polishing finisher is in use, it is fixed on the back of the abrasive belt in the polishing finisher. The operator could control the driving device of the polishing finisher to bring the abrasive belt into transmission. When curved surfaces of different curvatures on the work piece to be processed are to be polished, the motor is driven to work to bring the connection support and the support finishing wheels connected round the connection support into rotation about the output shaft thereof. When the support finishing wheel of the corresponding curvature rotates to the back of the abrasive belt to be positioned, the outer circumference of the support finishing wheel is beyond the original position of the abrasive belt, and the abrasive belt is pressed against the rim of the support finishing wheel to form a curved surface of a curvature the same as that of the rim of the support finishing wheel on the front surfaces thereof. The work piece to be processed is located here to finish the curved surface of the corresponding curvature. In the process of finishing, the support finishing wheel rotates around its own rotation axis, which could reduce the abrasion caused by the friction between the abrasive belt and the rim of the support finishing wheel. If curved surfaces of different curvatures have to be finished, the motor could be driven again to bring the support finishing wheel of the corresponding curvature to the back of the abrasive belt.

In the abrasive belt polishing finisher, the support finishing wheel comprises a wheel-like body and an annular finishing cover covered outside of the body, the back of the finishing cover is fixedly connected with the body, and a finishing curved surface is provided on the outer side thereof against the back of the abrasive belt.

In the abrasive belt polishing finisher, the finishing cover is made from rubber materials.

According to the first aspect of the connection support, in the abrasive belt polishing finisher, the connection support comprises a connection part fixedly connected with the outer end of the output shaft of the motor and several rod-like support parts disposed in the radial direction of the output shaft of the motor. The number of the support parts is the same as that of the support finishing wheels. The outer ends of the support parts are respectively connected with the support finishing wheels.

In the abrasive belt polishing finisher, the support parts are evenly distributed around the output shaft of the motor. The axis of the support finishing wheel is identical to that of the output shaft of the motor. The support finishing wheels are fixedly connected with the outer ends of the support parts through connection pieces opened along the axis of the support finishing wheels. The connection piece is a screw.

In the abrasive belt polishing finisher, the said finishing wheel transform mechanism further includes a controller and a detection module connected with the controller. The detection module is provided at the motor and the connection support and could detect that a stop signal is sent to the controller when the support finishing wheels along with the connection support rotate to the back of the abrasive belt. The controller could control the motor to stop working and be positioned after receiving the stop signal from the detection module. The detection module detects whether the support finishing wheel has turned to a set position, and the motor is automatically controlled by the controller, which provides a convenient operation and high control precision.

In the abrasive belt polishing finisher, the detection module includes a proximity switch and sensor blocks in the same number as the support finishing wheels disposed outside of the motor. Each of the sensor blocks is correspondingly fixedly connected with the support post connected with the support finishing wheel and could move to a position opposite to the proximity switch when it rotates to the back of the abrasive belt along with the support finishing wheel. The proximity switch is disposed outside of the motor and will not move. One side of the proximity switch which could detect the object faces to the back of the abrasive belt, and the proximity switch could detect the object is approaching and send the stop signal to the controller when the sensor block moves to a corresponding position.

In the other case, in the abrasive belt polishing finisher, the detection modules includes infrared receiving units fixedly connected with the outer side of the motor and infrared emitting units in the same number as that of the support finishing wheels. The infrared emitting units are corresponding to the support parts respectively and move to the positions corresponding to the infrared receiving units when they rotate to the back of the abrasive belt along with the support finishing wheels.

According to the first positioning mode of the connection support, in the abrasive belt polishing finisher, the motor is a brake motor. An electro-magnetic brake is located at the tail of the brake motor. When the motor is powered on, the electro-magnetic brake will be powered on and pulled in, and the motor will not be braked. When the motor is powered off, the electro-magnetic brake is powered off as well. The motor is braked by the brake under the action of the spring, so that the output shaft thereof will not rotate any more and be positioned.

According to the second positioning mode of the connection support, in the abrasive belt polishing finisher, the transform mechanism further includes a solenoid valve on the connection support and several via holes opened on the connection support. The coils of the solenoid valve are connected to the supper supply loop of the motor. When the said support finishing wheels rotate to the back of the abrasive belt, the power supply loop stops supplying power to the motor and starts to supply power to the solenoid valve, to extend the outer end of the solenoid valve into one of several via holes.

A large amount of space of the area surrounded by the abrasive belt will be occupied when the connection support is located in the area surrounded by the finisher abrasive belt. In other words, relatively more space outside of the finisher will be occupied by the connection support and the support finishing wheels. The angle and position of the manipulator for holding the work piece have to change at times to ensure uniform polishing on the work piece in the process of polishing and finishing. As such, when the manipulator is located at the finisher adjacent to the back of the abrasive belt, it tends to collide with the connection support and the support finishing wheels, which impairs the reliability of polishing and finishing of the work piece.

In order to address the aforesaid problem, as an improvement, in the abrasive belt polishing finisher, the abrasive belt polishing finisher further comprises a frame, a driving wheel and a driven wheel provided on the frame, and an abrasive belt covered on the driving wheel and the driven wheel. A driving mechanism connected with the finishing wheel transform mechanism is further provided on the frame. The connection support in the finishing wheel transform mechanism could move between a first position and a second position along the axis of the support finishing wheels. In the first position, the driving mechanism drives the connection support in movement to disengage the support finishing wheels from the abrasive belt and locate the support finishing wheels out of an area surrounded by the abrasive belt. In the second position, the driving mechanism drives the connection support to move into the area surrounded by the abrasive belt and makes the support finishing wheels right toward the back of the abrasive belt, and the support finishing wheels could be in contact with the abrasive belt driven by the finishing wheel transform mechanism.

The driving wheel drives the abrasive belt into rotation to grind the surface of the work piece in contact with the abrasive belt. When a curved surface is to be polished on the surface of the work piece, the connection support could be driven by the driving mechanism to move to the second position along the axis of the support finishing wheel thereon, and a support finishing wheel on the connection support is selected according to the curvature of the curved surface required by the surface of the work piece. A shape identical to the rim of the selected support finishing wheel is formed on the surface of the abrasive belt. As a result, the curved surface could be polished when the work piece is in contact with the surface of the abrasive belt.

When the support finishing wheel on the connection support does not have to be used, the connection support could move reservedly to the first position merely controlling the driving mechanism. The connection support is away from the back of the abrasive belt and returns to its initial position. As the connection support could move along the axis of the support finishing wheel by using the driving mechanism, the connection support is away from the back of the abrasive belt when it does not have to used, and space on the back of the abrasive belt on the frame could be completely left. Such a structure could largely save the space and facilitate operation of the manipulator, for which the work piece could be better polished.

In the abrasive belt polishing finisher, connection rod finishing wheels movable between the polishing position and the reset position are further provided in the area surrounded by the abrasive belt. In the polishing position, the connection support moves to the first position to disengage the support finishing wheels from the abrasive belt and locate the support finishing wheels out of the area surrounded by the abrasive belt, and the connection rod finishing wheels move to the back of the abrasive belt and contact with the abrasive belt. In the reset position, the connection rod finishing wheels disengage from the back of the abrasive belt to return to the area surrounded by the abrasive belt.

In the abrasive belt polishing finisher, the connection rod finishing wheels are respectively located above and under the connection support, and the position of the connection rod finishing wheels in contact with the abrasive belt after moving is identical to that of the support finishing wheels in contact with the abrasive belt after the connection support moves.

Particularly, in the abrasive belt polishing finisher, a first connection rod and a first driving cylinder are provided on the frame. The first connection rod and the first driving cylinder are located above the connection support and out of the area surrounded by the abrasive belt. One end of the first connection rod is hinged to the frame and the other end thereof is connected with the connection rod finishing wheel within the area surrounded by the abrasive bet. The end of the piston rod of the first driving cylinder is hinged to the first connection rod and the end of the cylinder body of the first driving cylinder is hinged to the frame. As the connection rod finishing wheel is only fixed on the first connection rod and both the connection rod finishing wheel and the connection rod are located out of the area surrounded by the abrasive belt, the operation of the manipulator will not be hindered by the connection rod finishing wheel, and in the meantime, the connection rod finishing wheel is pressed against the back of the abrasive belt and a curve surface could be polished on the surface of the work piece. Furthermore, the piston rod of the driving cylinder could drive the first connection rod to retract inward to the upper part of one side of the frame. Meanwhile, no much space will be occupied on the frame while the use function is enhanced.

Several connection rod finishing wheels could be provided. In the abrasive belt polishing finisher, the frame is provided with a second connection rod and a second driving cylinder. The second connection rod and the second driving cylinder are located under the connection support and out of the area surrounded by the abrasive belt. One end of the second connection rod is hinged to the frame and the other end thereof is connected with the connection rod finishing wheel within the area surrounded by the abrasive bet. The end of the piston rod of the second driving cylinder is hinged to the second connection rod. The curved surface of the rim of the connection rod finishing wheel on the first connection rod has a curvature different from that of the connection rod finishing wheel on the second connection rod.

The scope of application of the abrasive belt polisher could be increased by using the connection rod finishing wheels. The curvature of the curved surface of the rim of the connection rod finishing wheel on the first connection rod is set different from that of the connection rod finishing wheel on the second connection rod, so that when the operation of the manipulator is hindered by the connection support, the connection rod finishing wheel on the first connection rod or the connection rod finishing wheel on the second connection rod could be selected according to the curvature of the curved surface required by the surface of the work piece. While one connection rod finishing wheel extends out, the other connection rod finishing wheel is in a retracted state.

In the abrasive belt polishing finisher, the connection support is located at the central part of the frame. The driving mechanism includes a telescopic cylinder on the frame. The cylinder body of the telescopic cylinder is fixed on the frame. A telescopic piston is provided within the telescopic cylinder. The telescopic piston passes through the side of the frame and is linked with the connection support. When the connection support has to be pushed out, air is supplied to the cylinder body of the telescopic cylinder from an air supply, and the telescopic piston is pushed out from inside of the cylinder body under the force of the air pressure. As the telescopic piston passes through the side of the frame and is linked with the connection support, when the telescopic piston is pushed out, the connection support could be pushed to a designated position on the back of the abrasive belt. When the connection support does not have to be used or the deformation of the manipulator is hindered by the connection support, the telescopic piston retracts inward to bring the connection support to retract inward therewith, and the connection support is away from the back of the abrasive belt.

In the abrasive belt polishing finisher, the cylinder body of the telescopic cylinder and the telescopic piston are both cylindrical. The telescopic piston has an inner cavity. A rotary motor is fixed within the telescopic piston and the output shaft of the rotary motor extends out from the inside of the telescopic piston and is connected with the connection support. As the rotary motor is located within the telescopic piston, the mounting space on the frame could be saved and a simpler structure is provided. When the telescopic cylinder is pushed out to locate the connection support on the back of the abrasive belt, the rotation of the connection support could be controlled merely by controlling the rotation of the output shaft of the rotary motor and the required support finishing wheel will be selected to be pressed against the back of the abrasive belt.

In the abrasive belt polishing finisher, a positioning cylinder is further fixed within the telescopic piston. Several positioning bores are evenly distributed on the connection support on the same circle using the rotation center thereof as the center of circle. The piston rod of the said positioning cylinder could extend out from the inside of the telescopic piston and insert into the positioning bores. When the telescopic piston is pushed outward to locate the connection support on the back of the abrasive belt, the connection support could be controlled by the rotary motor to rotate until the finishing wheel thereon is pressed against the back of the abrasive belt. In order to guarantee the reliability in operation and prevent the connection support from being collided and influenced, the piston rod of the positioning cylinder within the telescopic piston is controlled to be pushed out and inserted into the positioning bore on the current connection support corresponding to the position of the piston rod of the positioning cylinder, for which the connection support will be held stationary.

In the abrasive belt polishing finisher, the cylinder body of the said telescopic cylinder has a chute opened from the end to the middle on its side. The side of the telescopic piston is connected with a lug which could slide along the chute. The lug is located within the chute and a portion of the lug extends out of the chute. When the lug is pressed against the end of the chute, the connection support is located at the back of the abrasive belt. Air is supplied to the cylinder body of the telescopic cylinder from an air supply. The telescopic piston within the cylinder body is pushed out under the force of the air pressure. The lug connected with the side of the telescopic piston will move along the chute on the side of the cylinder body. When the lug is moved and pressed against the end of the chute, the connection support is exactly located on the inner side of the abrasive belt, which not only ensures the connection support will be accurately pushed to a designated position, but also achieves the position restricting effect to ensure the telescopic piston will not fall off from the cylinder body.

In the abrasive belt polishing finisher, a housing is fixed on the side of the frame opposite to the connection support. The driving mechanism has a spin motor fixed on the end of the housing. A via hole is provided on the side of the frame corresponding to the connection support. A positioning sleeve having an inner cavity is threaded with the via hole. The positioning sleeve is located within the housing and the output shaft of the spin motor is connected with one end of the positioning sleeve. The rotary motor is provided within the positioning sleeve. The output shaft of the rotary motor extends out from the other end of the positioning sleeve and is connected with the connection support. The output shaft of the spin motor is controlled to rotate forward. As the output shaft of the spin motor is linked with the positioning cylinder and the positioning cylinder is threaded with the via hole, the forward rotation of the output shaft of the spin motor will bring the positioning cylinder to extend out from the inside of the housing along the threaded section, and lead the connection support to be on the inner side of the abrasive belt. Thereafter, the output shaft of the rotary motor is controlled to drive the connection support into rotation, so that the finishing wheel on the connection support is pressed against the inner side of the abrasive belt. When the connection support does not have to be used or the deformation of the manipulator is hindered by the connection support, the positioning sleeve could be retracted into the housing merely by controlling the output shaft of the spin motor to rotate anticlockwise.

In the abrasive belt polishing finisher, a housing is fixed on the side of the frame opposite to the connection support. The driving mechanism has a spin motor fixed on the end of the housing. A via hole is provided on the side of the frame corresponding to the connection support. A positioning sleeve having an inner cavity is threaded with the via hole. The end of the output shaft of the spin motor is fixedly connected with a first transmission gear. The positioning sleeve is located within the housing and an inner gear ring is fixed on one end of the positioning sleeve. Several second transmission gears are further provided between the first transmission gear and the inner gear ring. The rotary motor is provided within the positioning sleeve. The output shaft of the rotary motor extends out from the other end of the positioning sleeve and is connected with the connection support.

According to the second aspect of the connection support, in the abrasive belt polishing finisher, the connection support is of a round-disk shape, and connection blocks of a Z-shape are disposed on the connection support. The bottoms of the connection blocks are fixed on the connection support and the support finishing wheels are connected with the upper parts of the connection blocks. The Z-shape connection blocks could make the distance of the connection support extending into the back of the abrasive belt to increase, and reduce the space occupied and shorten the distance of the connection support moving in the axial direction, which ensures the reliability of the structure.

In the abrasive belt polishing finisher, elongated mounting grooves are opened through the bottom of the connection block. Several support posts which are arranged in the radial direction of the connection support and integrated with the connection support are provided at the edge of the connection support. Several mounting holes in a linear arrangement are correspondingly provided on the support post and the connection support. The connection blocks are linked with the support posts through fasteners which could pass through the mounting grooves (21) and insert into the mounting holes.

By using the mounting grooves at the bottom of the connection block and the mounting holes in a linear arrangement on the support post, the position of the connection block in the direction of the support post could be adjusted. As such, when the rim of the finishing wheel is worn to a small extent by the long-period operation of the finishing wheel fixed on the connection block, the connection block could be moved to offset the wear.

A convex guide strip is disposed at the bottom of the connection block and a guide groove is correspondingly opened on the support post of the connection support. The guide strip and the guide groove are provided to conveniently and rapidly connect the connection block to the support post.

Compared with the prior art, by using the finishing wheel transform mechanism of the abrasive belt polishing finisher of the invention, a curved surface of a different curvature could be polished with a high quality on the work piece. The finishing wheel transform mechanism has a wide scope of application, convenient operation and high operation efficiency. In the meantime, the abrasive belt polishing finisher uses the driving mechanism to achieve the movement of the connection support on the finishing wheel thereon along the axis. The connection support is away from the inner side of the abrasive belt when it is not in use, which largely saves the space of the frame on the inner side of the abrasive belt during polishing, and ensures the manipulator is not affected when it is adjacent to the frame at the back of the abrasive belt. Moreover, the operation of the manipulator could be switched adjacent to the frame of the abrasive belt, which ensures the reliability of polishing and uniformity of polishing precision everywhere on the surface of the work piece. In the abrasive belt polishing finisher, a first connection rod and a second connection rod are respectively hinged to the upper and lower parts on the one side of the frame. The space on the side of the frame will not be occupied whether or not the first connection rod and the second connection rod have to be used. While the space of the frame on the inner side of the abrasive belt is saved, a curved surface can be polished on the surface of the work piece, which provides higher usefulness.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The embodiments of the invention will be described below and the technical solutions of the invention will be further illustrated in connection with the accompanying figures. However, the present invention shall not be limited to these embodiments.

First Embodiment

Figure 1:
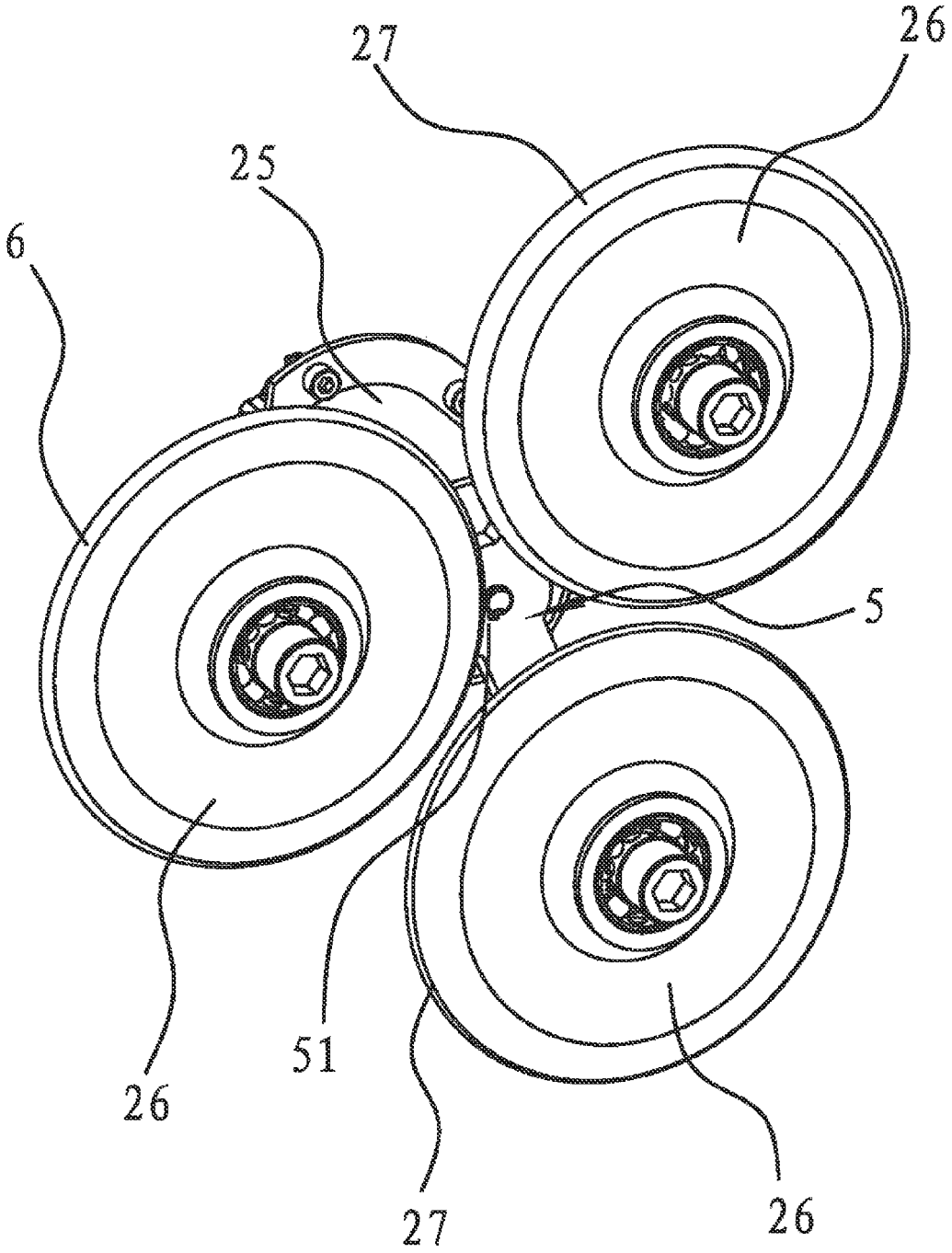
FIG. 1 is a structural diagram of the finishing wheel transform mechanism of the abrasive belt polishing finisher of the invention.
Figure 2:
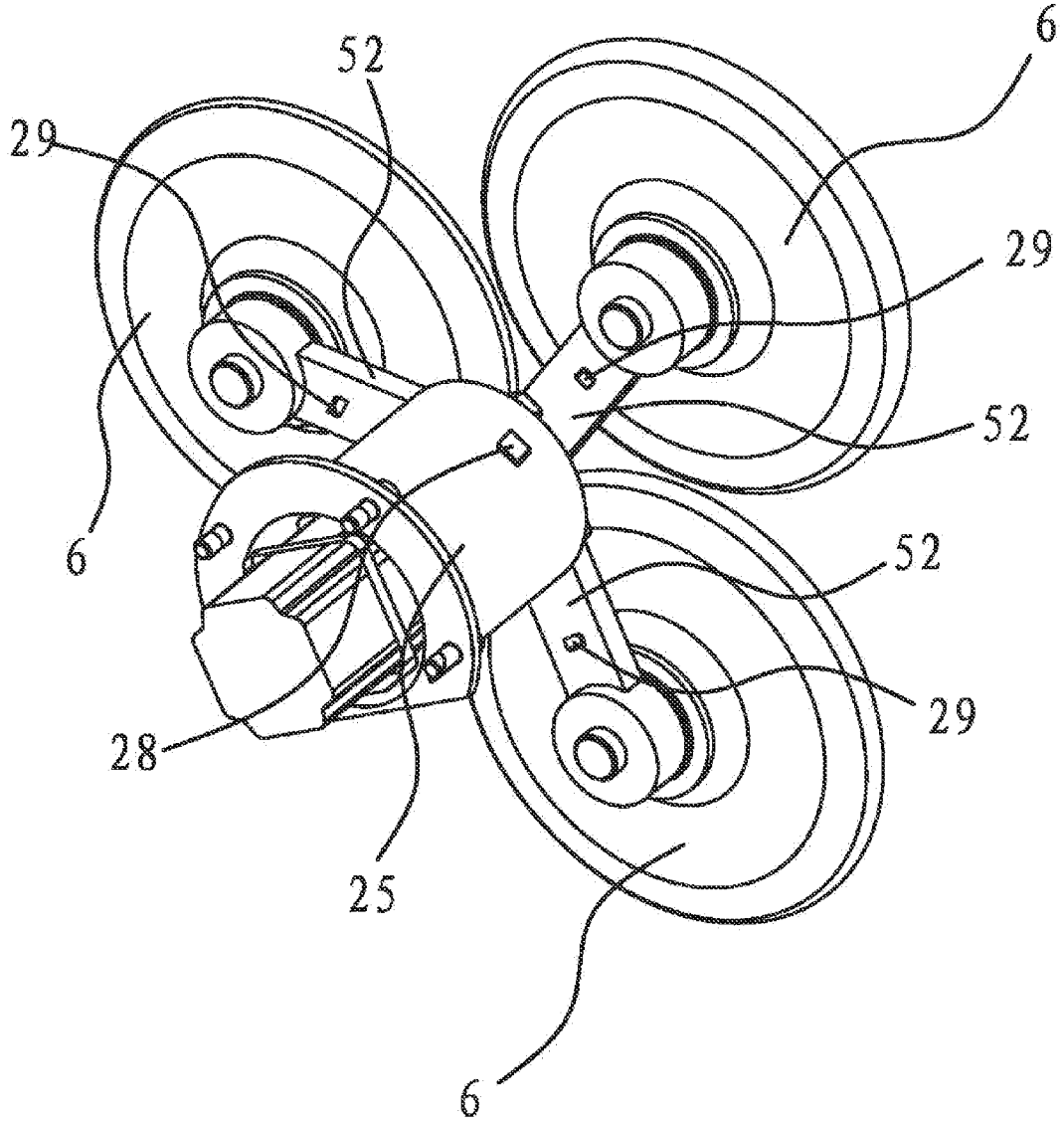
FIG. 2 is a structural diagram of the finishing wheel transform mechanism of the abrasive belt polishing finisher of the invention from another angle of view.
Figure 4:
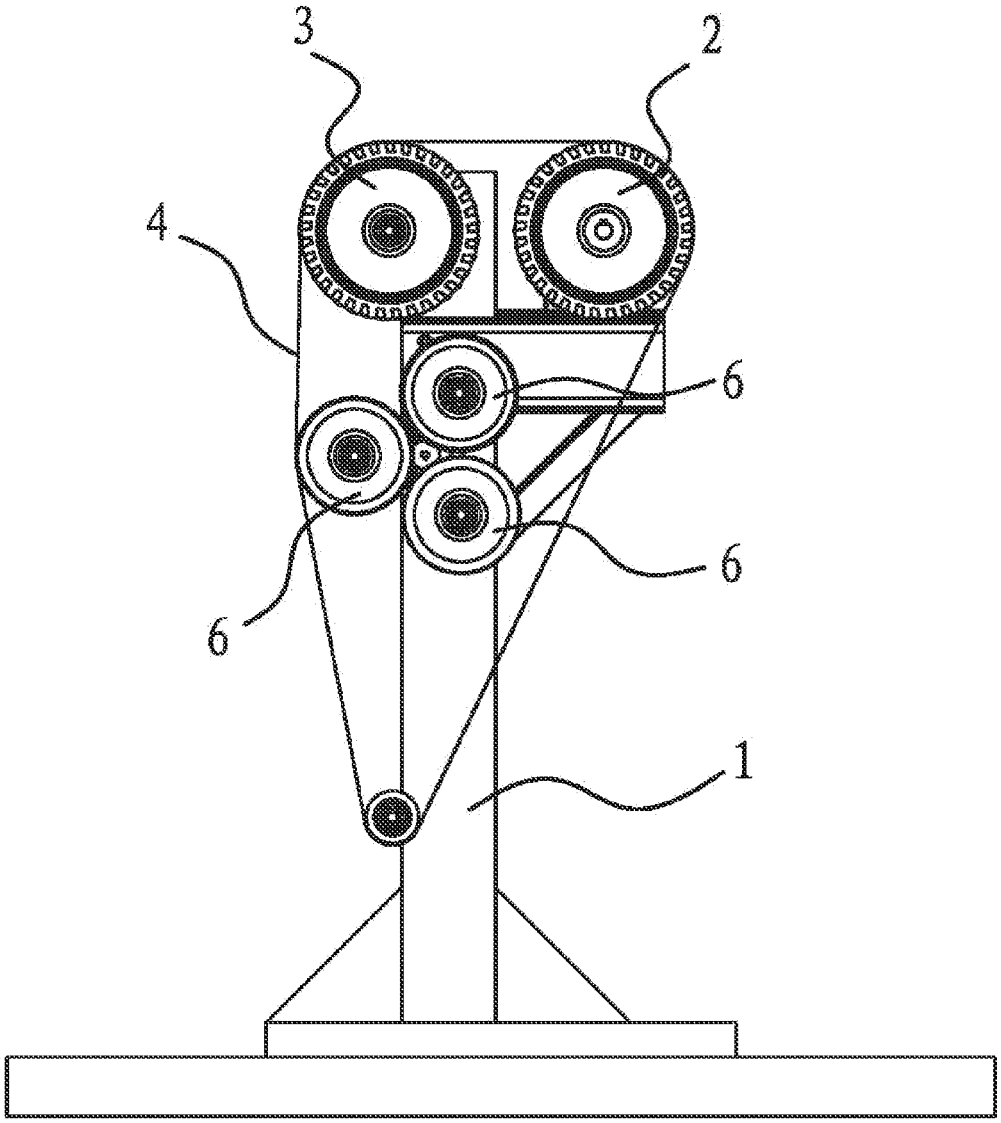
FIG. 4 is a structural diagram of the finishing wheel transform mechanism of the abrasive belt polishing finisher of the invention being applied to the abrasive belt polishing finisher.

As shown in FIGS. 1, 2 and 4, the abrasive belt polishing finisher of the invention comprises a frame 1, a driving wheel 2 and a driven wheel 3 provided on the frame 1, and an abrasive belt 4 covered on the driving wheel 2 and the driven wheel 3. The finishing wheel transform mechanism on the frame 1 includes a motor 25, a connection support 5 fixedly connected with the output shaft of the motor 25 at the central section, and three support finishing wheels 6 connected around the connection support 5. The number of the support finishing wheels 6 could be 2, 4, 5 or more as required. The connection support 5 includes an annular connection part 51 and rod-like support parts 52 in the same number as that of the support finishing wheels 6. The connection part 51 is covered outside of and fixedly connected with the output shaft of the motor 25. The inners end of the support parts 52 are integrated with the outer side of the connection part 51, and the other ends thereof are respectively connected with the support finishing wheels 6. Three support parts 52 are provided. The support parts 52 diverge outward in the radial direction along the output shaft of the motor 25. Three support parts 52 are evenly distributed about the output shaft of the motor 25 for which an angle of 120 degrees is formed between every two support parts 52. Three support finishing wheels 6 are provided and the axis of the support finishing wheel 6 is in the same direction as that of the output shaft of the motor 25. The support finishing wheel 6 is fixed to the outer end of the support part 52 by means of a screw passing through the axis. Three support finishing wheels 6 are distributed on the same circle centered on the output shaft of the motor 25.

Figure 3:
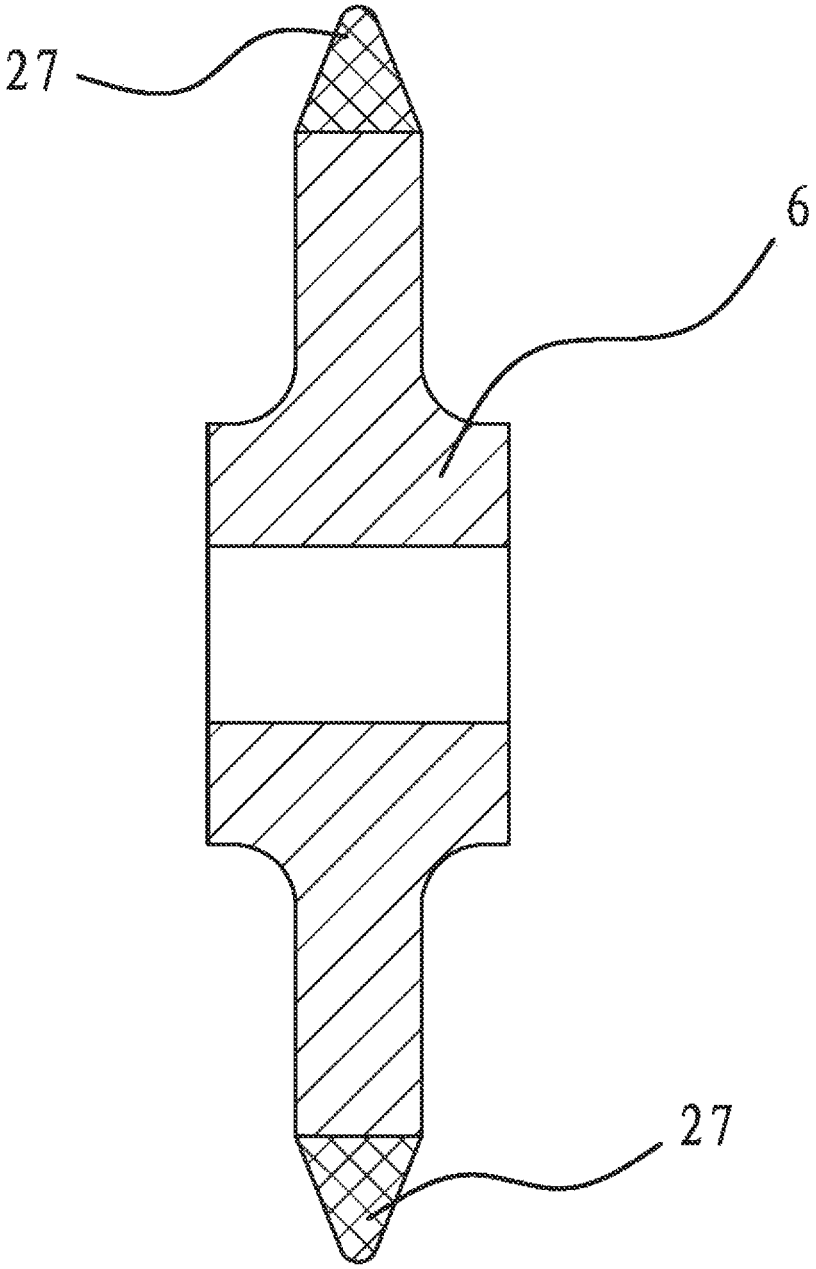
FIG. 3 is a sectional view of the finishing wheel in the finishing wheel transform mechanism of the abrasive belt polishing finisher of the invention.

As shown in FIG. 3, the support finishing wheel 6 includes a wheel-like body 26 and an annular finishing cover 27 covered outside of the body 26. The inner side of the finishing cover 27 is fixedly connected with the outer side of the body 26. A finishing curved surface in contact with the back of the abrasive belt 5 of the polishing finisher is provided on the outer side of the finishing cover 27. The curvatures of the finishing curved surfaces on the said three finishing covers 27 are gradually increased. In this embodiment, the finishing cover 27 is made of rubber materials and fixedly connected with the body 26 by casting. Three support parts 52 have the same length. Three support finishing wheels 6 have the same diameter and all the axial centers of the three support finishing wheels 6 are located on the same circle centered on the output shaft of the motor 25.

The finishing wheel transform mechanism of the abrasive belt polishing finisher further comprises a controller and a detection module connected to the controller. The detection module is correspondingly positioned at the motor 25 and the connection support 5 and could detect that a stop signal is sent to the controller when the support finishing wheels 6 along with the connection support 5 rotate to the back of the abrasive belt 5 about the output shaft of the motor 25. The controller could control the motor 25 to stop working and be positioned after receiving the stop signal.

In this embodiment, the diction module includes a proximity switch 28 and three sensor blocks 29 disposed outside of the motor 25. One side of the proximity switch 28 for detecting adjacent objects is faced to the back of the abrasive belt 5. Each of the three sensor blocks 29 is fixedly connected with the support part 52 and located on one side of the motor 25 correspondingly, and the sensor blocks 29 could move to a position opposite to the proximity switch 28 when they rotate to the back of the abrasive belt 5 along with the support finishing wheels 6. The motor 25 could be a brake motor 25, in which the brake generally means an electro-magnetic mechanical brake device at the back end of the servo motor 25, which is mounted at the back end of the motor 25. The motor 25 is braked and the main shaft of the motor 25 is locked to be positioned through the brake sheet acted on the main shaft of the motor 25 in operation.

With reference to FIG. 4, when the finishing wheel transform mechanism of the abrasive belt polishing finisher of the invention is in use, the finishing wheel transform mechanism is mounted on the back of the abrasive belt 5 in the polishing finisher to control the driving device of the polishing finisher to drive the abrasive belt 5 in transmission, for which only the ordinary surface of the work piece could be finished. With respect to special curved surfaces to be finished, the operator could select corresponding support finishing wheels 6 based upon the curvature of the surface to be polished of the work piece to be processed. The operation of the motor 25 could be controlled to drive the connection support 5 and the support finishing wheels 6 around the connection support 5 to rotate to the abrasive belt 5 around the output shaft of the motor 25.

When the support finishing wheel 6 rotates to the back of the abrasive belt 5, the sensor block 29 connected to the support part 52 correspondingly connected with the support finishing wheel 6 moves to a position opposite to the proximity switch 28. A stop signal is sent to the controller when the proximity switch 28 detects the object is adjacent. The controller controls the brake motor 25 to stop working and lock the main shaft. Meanwhile, referring to FIG. 5, the outer side of the support finishing wheel 6 pressed against the abrasive belt 5 is beyond the original position of the abrasive belt 5. The abrasive belt 5 is closely pressed on the finishing cover 27 outside of the support finishing wheel 6 and a shape 43 identical to the finished curved surface outside of the finishing cover 27 is formed on the front surface of the abrasive belt 5. The surface of the work piece could thus be finished by the abrasive belt 5 in transmission. The support finishing wheel 6 rotates by itself while the abrasive belt 5 is in transmission, so that rolling friction is formed between the finishing cover 27 and the back of the abrasive belt 5 to reduce abrasion.

After finishing is completed, if support finishing wheels 6 of other curvatures are required, the controller could control the motor 25 again to discharge the brake and activate. The motor 25 could turn by 120 degrees or 240 degrees to rotate the corresponding support finishing wheel 6 to the back of the abrasive belt 5. The specific operation is the same as that described above. When three support finishing wheels 6 are not required to be used any more, the controller could control the motor 25 to drive the connection part 51 rotate by 60 degrees. In the meantime, two adjacent support finishing wheels 6 are both close to but not in contact with the back of the abrasive belt 5, and the abrasive belt could be in normal operation. The control of the controller could be set as desired. Corresponding control commands could be provided to the controller by adding operation buttons or automatic control could be performed by software program input into the controller in advance.

Second Embodiment

The second embodiment is substantially the same as the first embodiment except the positioning of the detection module and the connection support. The detection modules includes infrared receiving units fixedly connected with the outer side of the motor 25 and infrared emitting units in the same number as that of the support finishing wheels 6. The infrared emitting units are corresponding to the three support parts 52 respectively and move to the positions corresponding to the infrared receiving units when they rotate to the back of the abrasive belt 5 along with the connection support 5. Here, in order to set aside the reaction time for control, the detection position could be put ahead by some distance, and the specific distance could be determined as required. Alternatively, a servo motor or stepper motor for precise control of the positioning operation could be used. The rotation angle could be precisely positioned by the controller to control the precise positioning of the support finishing wheels 6. The positioning of the connection support 5 could be achieved by using a solenoid valve and several via holes opened on the connection support 5. The coils of the solenoid valve are connected to the supper supply loop of the motor 25. When the said support finishing wheels 6 rotate to the back of the abrasive belt, the power supply loop stops supplying power to the motor and starts to supply power to the solenoid valve, to extend the outer end of the valve rod of the solenoid valve into one of several via holes.

Third Embodiment

Figure 6:
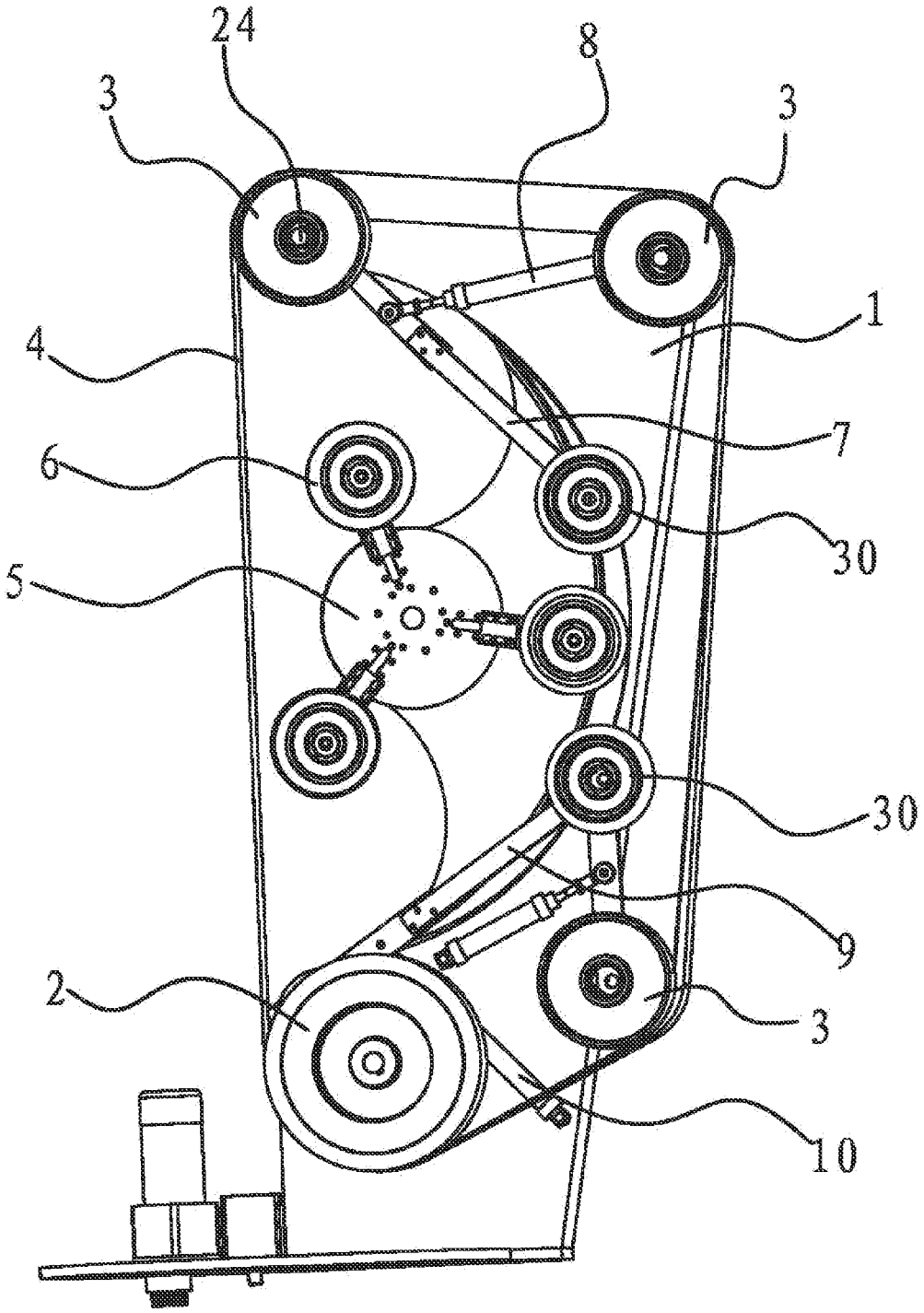
FIG. 6 is a diagram showing the connection support, the first connection rod and the second connection rod are all in a retracted state in the abrasive belt polisher.
Figure 8:
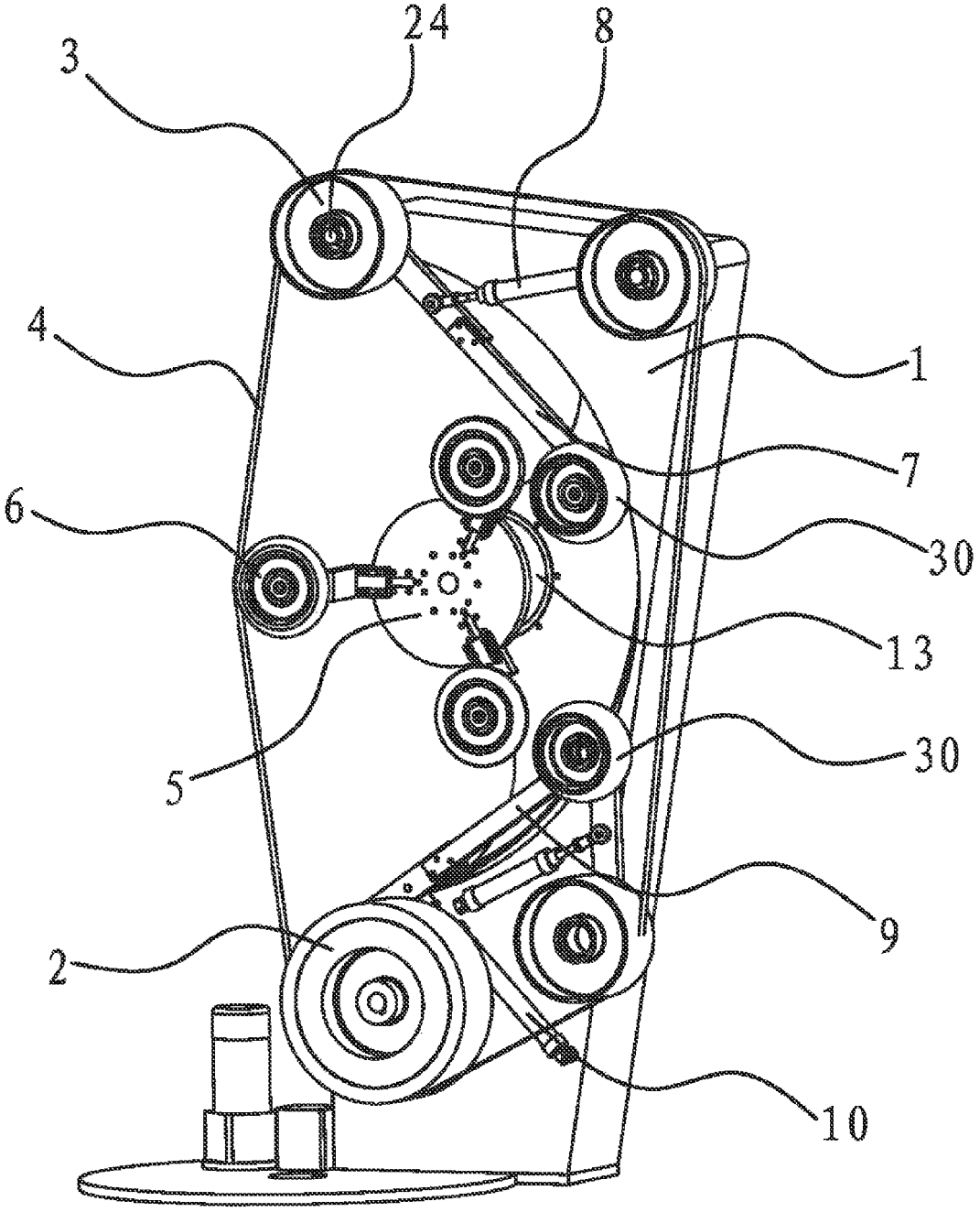
FIG. 8 is a structural diagram showing the finishing wheel on the connection support is pressed against the back of the abrasive belt in the abrasive belt polisher.
Figure 9:
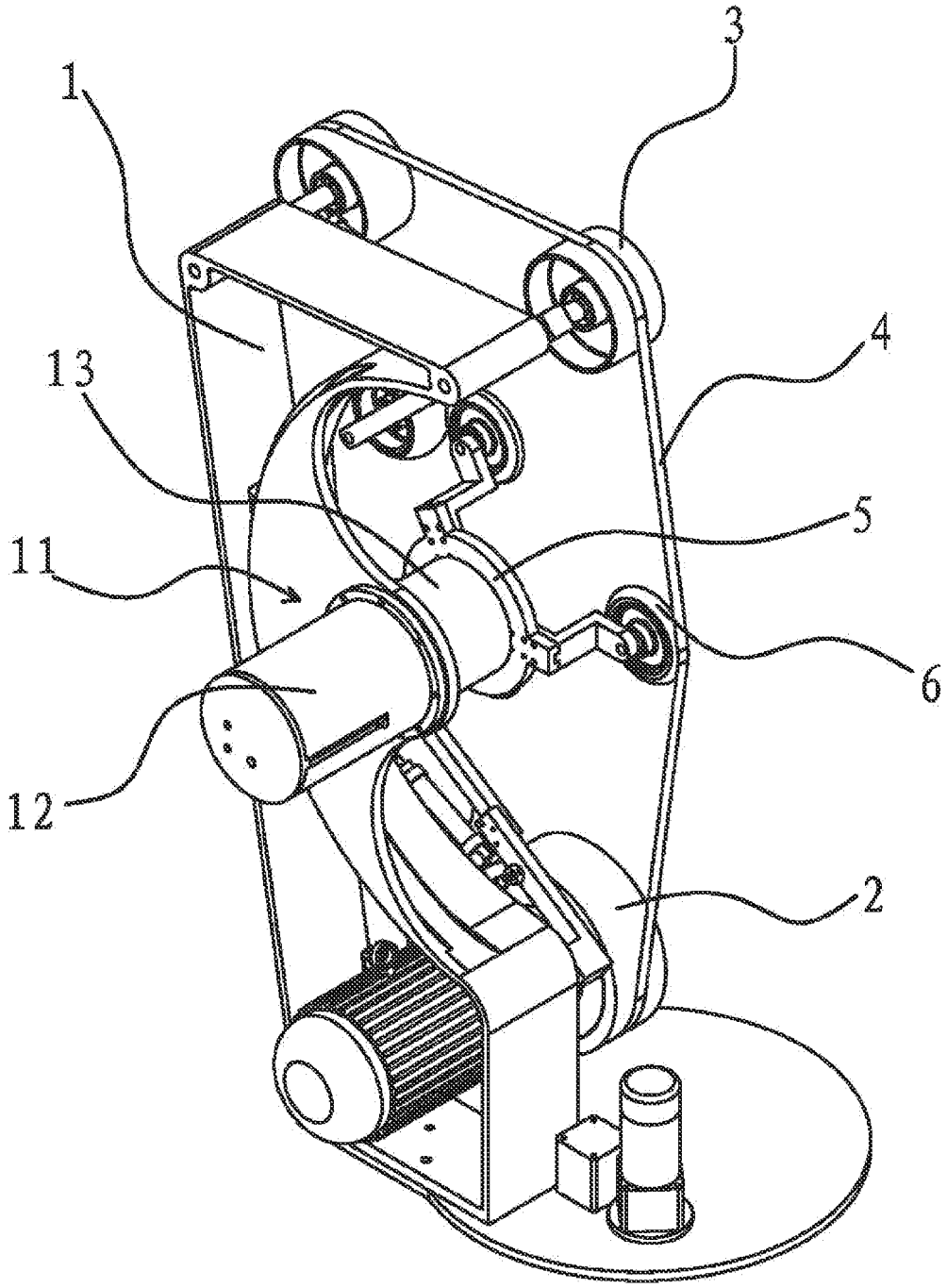
FIG. 9 is a back view of FIG. 8.
Figure 10:
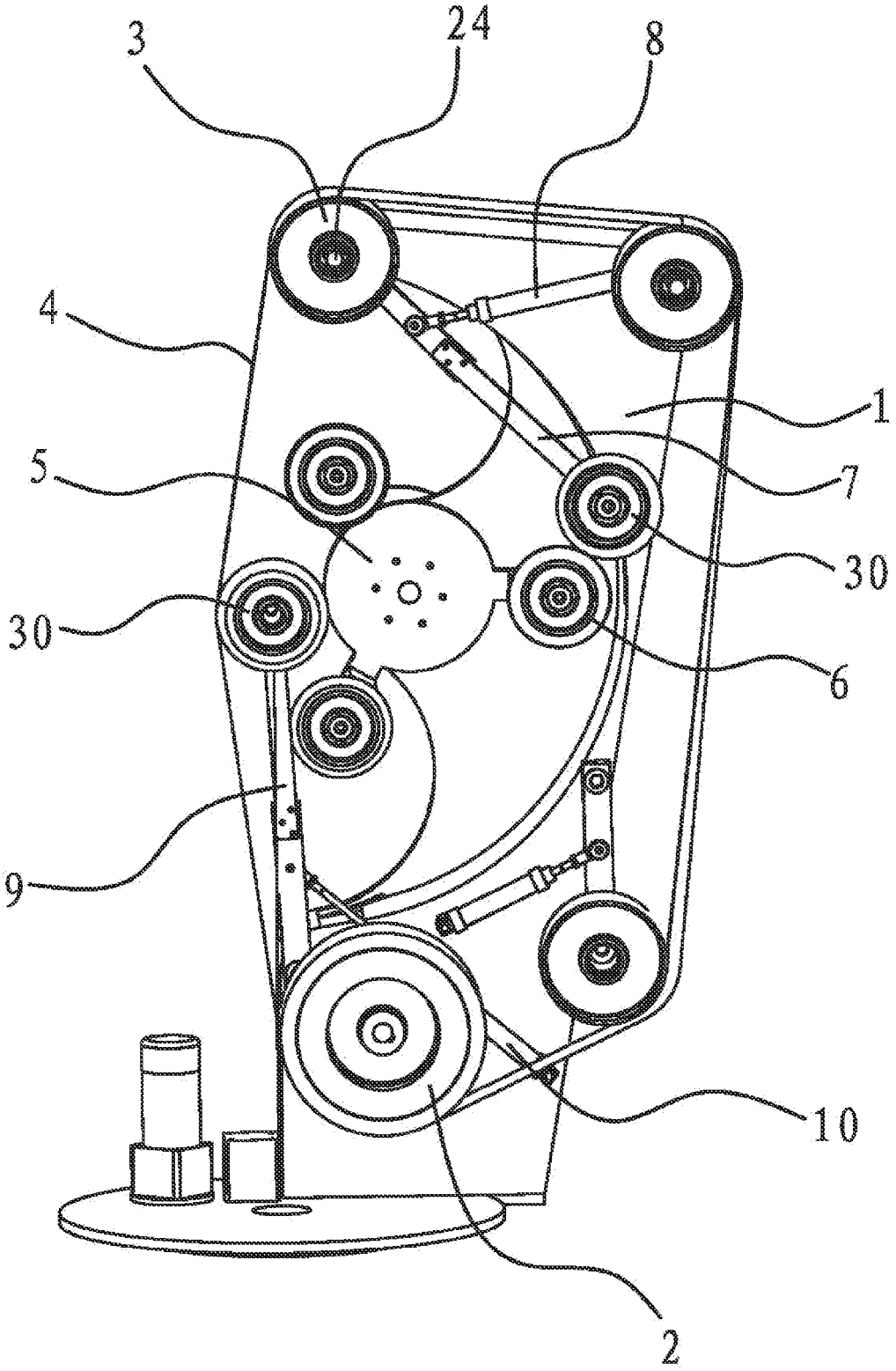
FIG. 10 is a diagram showing the finishing wheel on the first connection rod is pressed against the back of the abrasive belt in the abrasive belt polisher.
Figure 11:
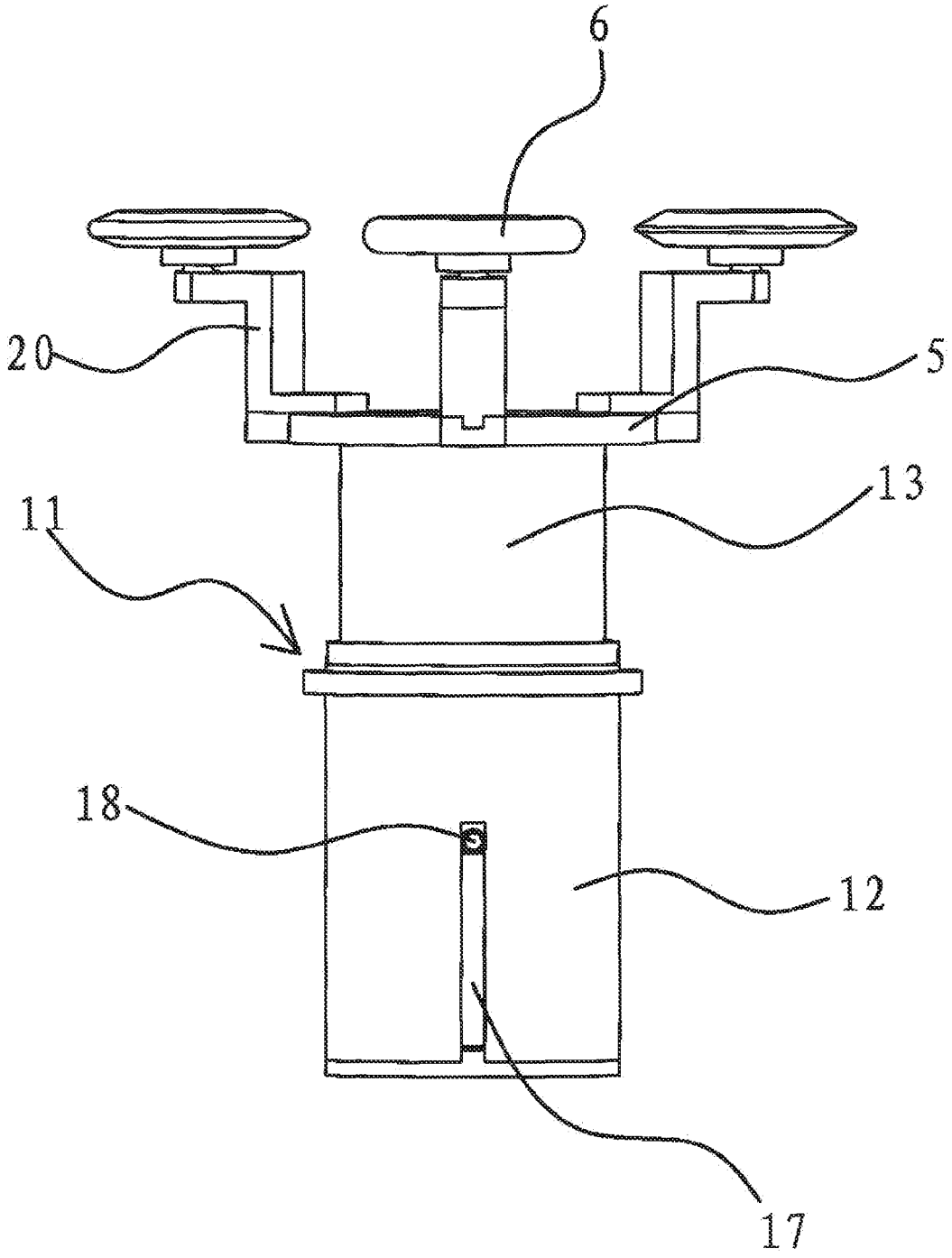
FIG. 11 is a diagram showing the connection of the connection support with the telescopic cylinder in the abrasive belt polisher.
Figure 12:
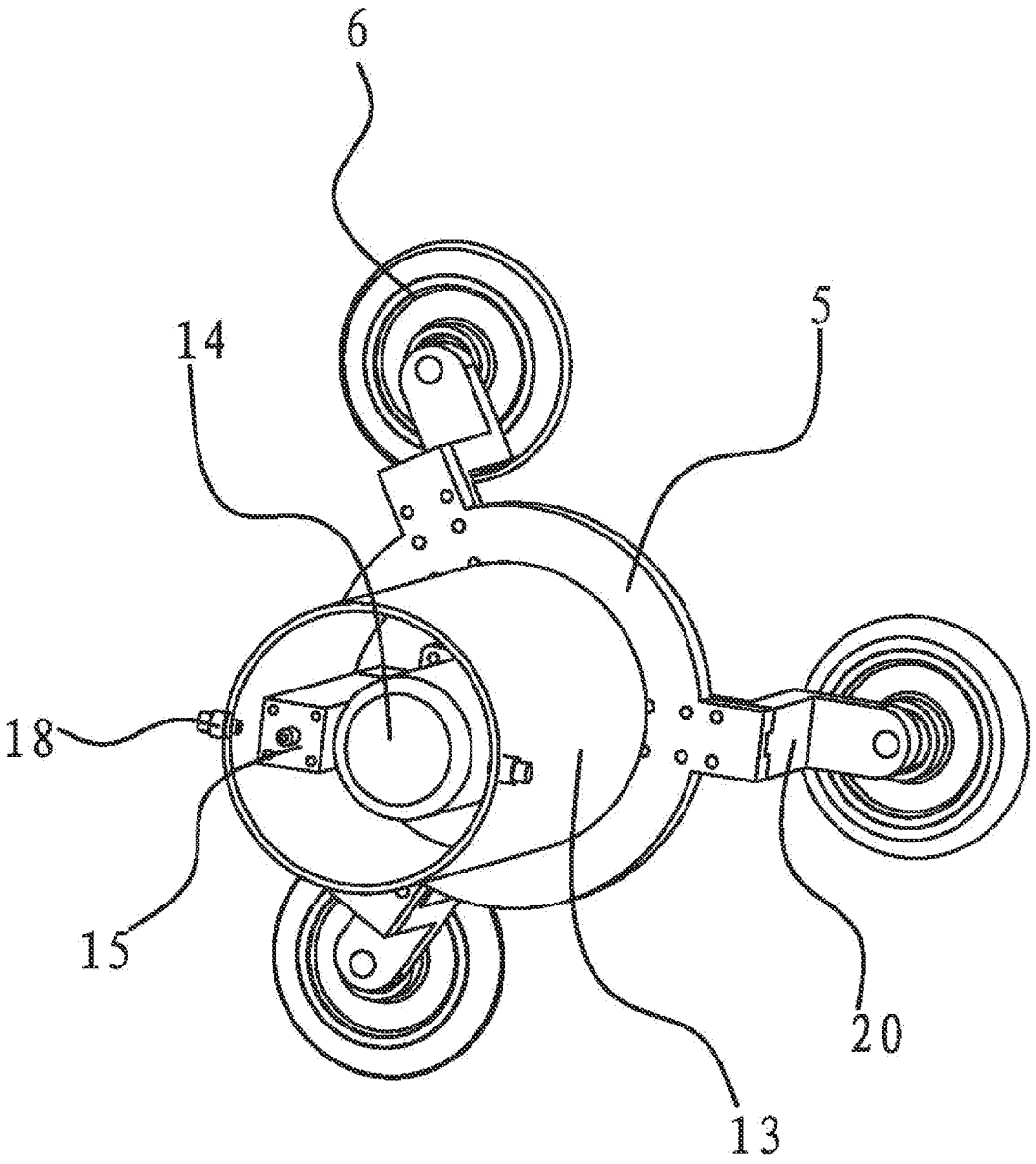
FIG. 12 is a back view showing the connection of the connection support with the telescopic piston in the abrasive belt polisher.
Figure 13:
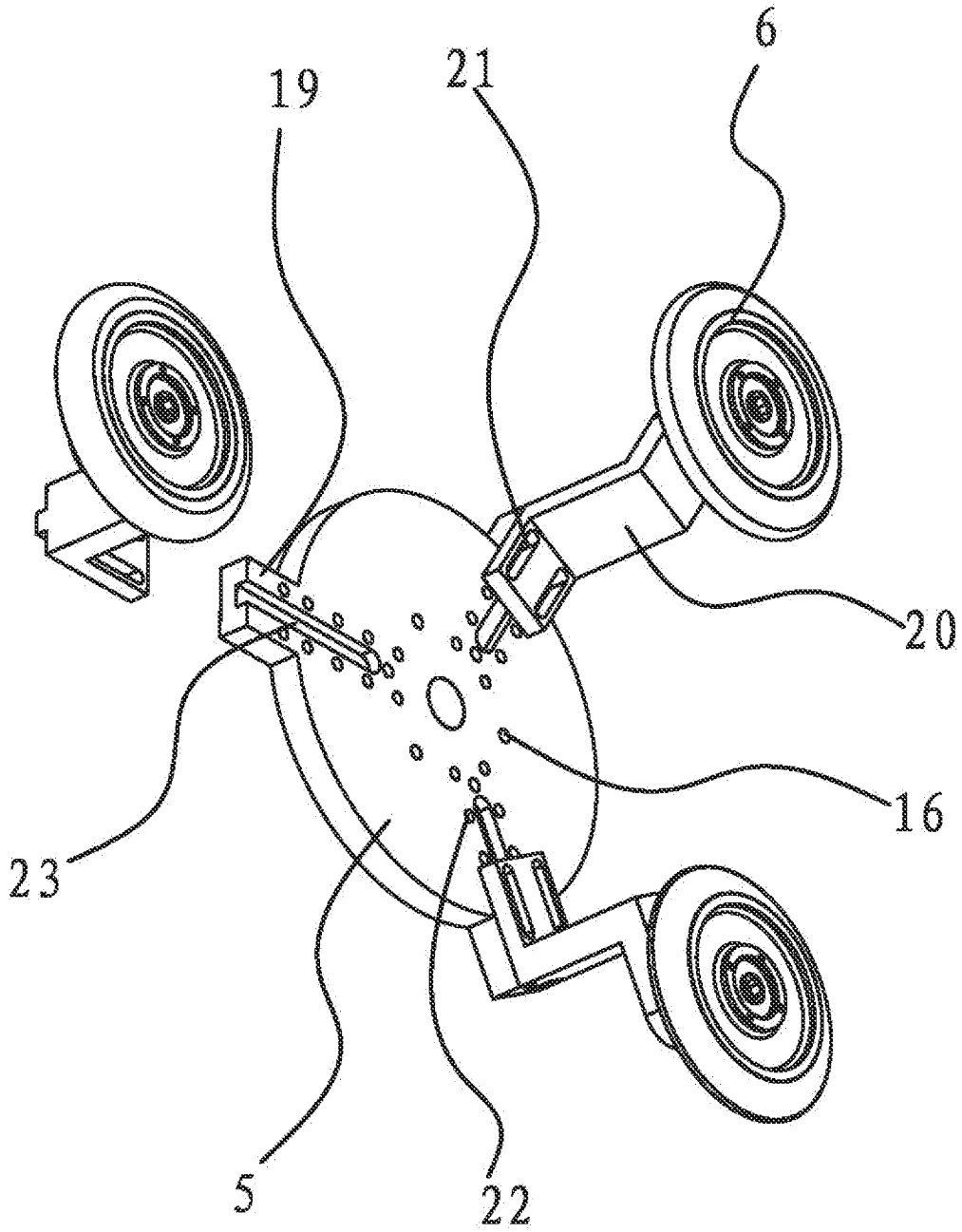
FIG. 13 is a structural diagram of the connection support in the abrasive belt polisher.

As shown in FIGS. 6, 8 and 10, the abrasive belt polishing finisher refers to an improvement to the finisher according to the first embodiment. The abrasive belt polishing finisher comprises a frame 1 and a driving wheel 2 and driven wheels 3 provided on the frame 1, and an abrasive belt 4 covered on the driving wheel 2 and the driven wheels 3. A driving mechanism connected with the finishing wheel transform mechanism of the first embodiment is further provided on the frame 1. The connection support 5 in the finishing wheel transform mechanism could move between a first position and a second position along the axis of the support finishing wheels 6. In the first position, the driving mechanism drives the connection support 5 in movement to disengage the support finishing wheels 6 from the abrasive belt and locate the support finishing wheels out of an area surrounded by the abrasive belt. In the second position, the driving mechanism drives the connection support to move into the area surrounded by the abrasive belt and makes the support finishing wheels 6 right toward the back of the abrasive belt, and the support finishing wheels 6 could be in contact with the abrasive belt driven by the finishing wheel transform mechanism. Connection rod finishing wheels 30 movable between the polishing position and the reset position are further provided in the area surrounded by the abrasive belt. In the polishing position, the connection support moves to the first position to disengage the support finishing wheels 6 from the abrasive belt and locate the support finishing wheels 6 out of the area surrounded by the abrasive belt. The connection rod finishing wheels move to the back of the abrasive belt and contact with the abrasive belt. In the reset position, the connection rod finishing wheels disengage from the back of the abrasive belt to return to the area surrounded by the abrasive belt. The connection rod finishing wheels are respectively located above and under the connection support. The position of the connection rod finishing wheels in contact with the abrasive belt after moving is identical to that of the support finishing wheels 6 in contact with the abrasive belt after the connection support moves.

In particular, the connection support 5 is provided at the central section on one side of the frame 1. Several support finishing wheels 6 evenly distributed using the rotation center of the connection support 5 as the center of circle, are connected with the peripheral of the connection support 5. The rim of each of the support finishing wheels 6 has a curved surface of a different curvature. The upper part of the side of the frame 1 provided with the connection support 5 has a positioning post 24 close to the back of the abrasive belt 5. The driven wheel 3 is connected with the positioning post 24 and a first connection rod 7 is coupled with the positioning post 24. The first connection rod 7 is connected between the driven wheel 3 and the side of the frame 1. The end of the first connection rod 7 is connected with a connection rod finishing wheel 30. A first driving cylinder 8 is provided at the upper part of the frame 1. The end of the piston rod of the first driving cylinder 8 is hinged to the first connection rod 7.

The driving wheel 2 is located at the lower part of the side of the frame 1 provided with the connection support 5 close to the back of the abrasive belt 4. A second connection rod 9 is hinged to the frame 1 adjacent to the driving wheel 2. The end of the second connection rod 9 is connected with a connection rod finishing wheel 30. A second driving cylinder 10 is provided at the lower part of the said side of the frame 1. The end of the piston rod of the second driving cylinder 10 is hinged to the second connection rod 9. The connection rod finishing wheel 30 on the first connection rod 7 has a curvature different from that of the curved surface of the rim of the connection rod finishing wheel 30 on the second connection rod 9.

As shown in FIG. 8, the connection support 5 is of a round-disk shape. Several support posts 19 diverging outward using the rotation center of the connection support 5 as the center of circle, are provided on the rim of the connection support 5. The support post 19 is connected with a connection block 20 of a Z-shape. A convex guide strip is disposed at the bottom of the connection block 20. A guide groove 23 is correspondingly opened on the support post 19 of the connection support 5. The guide strip could slide into the guide groove 23. Elongated mounting grooves 21 are opened at the bottom of the connection block 20. Several mounting holes 22 in linear arrangement are provided correspondingly on the support post 19. The connection block 20 is fixed to the support post 19 by using the bolts passing through the mounting grooves 21 and inserting into the mounting holes 22. The position of the connection block 20 along the extending direction of the support post 19 could be adjusted by using the mounting grooves 21.

As shown in FIGS. 1-7, a driving mechanism is further provided on the frame 1. The driving mechanism has a telescopic cylinder 11 on the other side of the frame 1 opposite to the connection support 5. The cylinder body 12 of the telescopic cylinder 11 is fixed on the frame 1. A telescopic piston 13 is provided within the cylinder body 12 of the telescopic cylinder 11. The telescopic piston 13 passes through the side of the frame 1 and is linked with the connection support 5. The connection support 5 could move along the axis of the support finishing wheel 6 to the inner side of the abrasive belt 4 driven by the driving mechanism, so that the rim of the support finishing wheel 6 thereon is opposite to the inner side of the abrasive belt 4.

Figure 7:
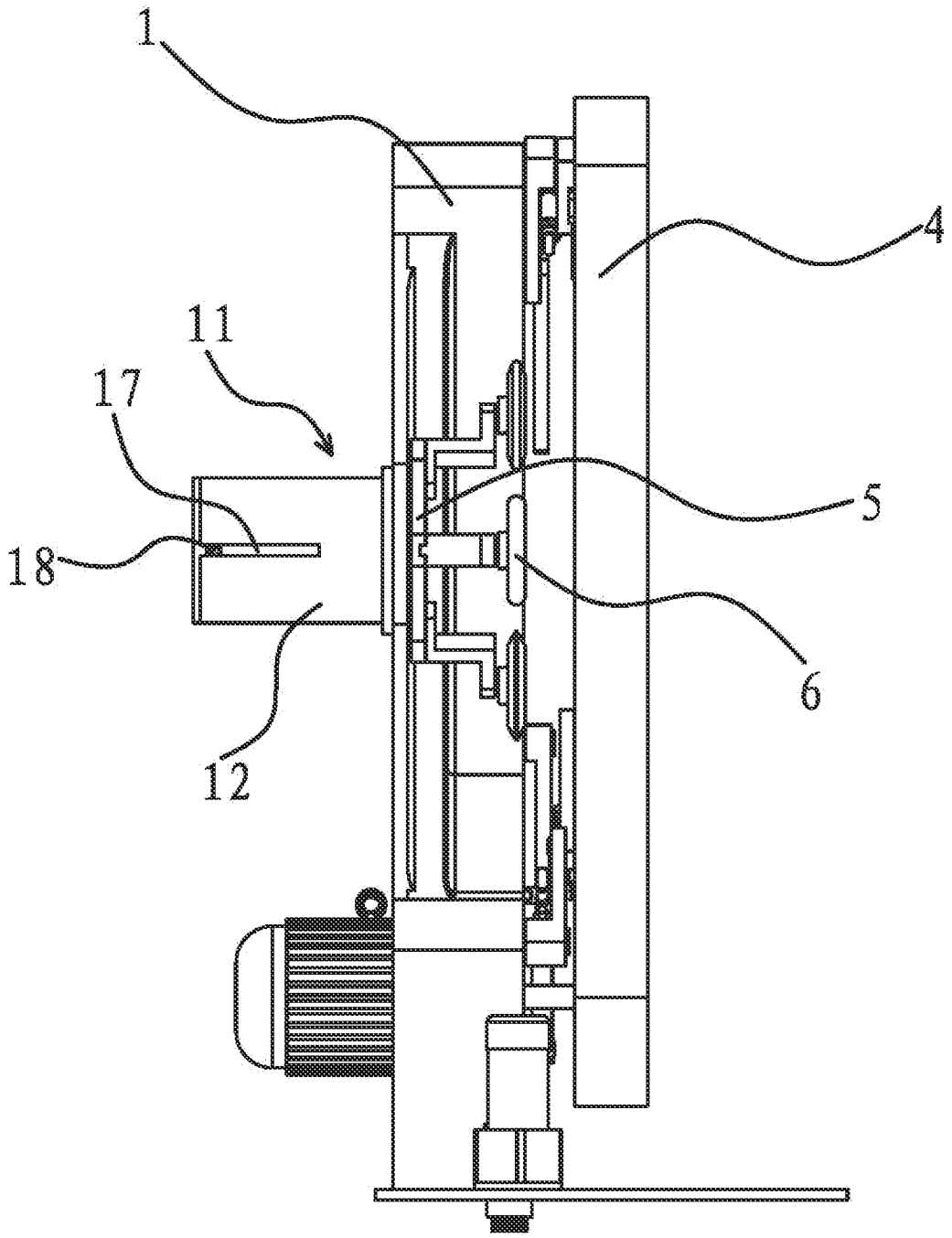
FIG. 7 is a side view of FIG. 6.

Referring to FIGS. 6 and 7, the cylinder body 12 of the telescopic cylinder 11 and the telescopic piston 13 are both cylindrical. The cylinder body 12 of the telescopic cylinder 11 has a chute 17 opened from the end to the middle on its side. The side of the telescopic piston 13 is connected with a lug 18. The lug is located within the chute 17 and a portion of the lug 18 extends out of the chute 17. When the lug 18 is pressed against the end of the chute 17, the connection support 5 moves to the inner side of the abrasive belt 4 along the axis of the support finishing wheels 6 thereon.

As shown in FIG. 7, the telescopic piston 13 has an inner cavity. A rotary motor 254 is fixed within the telescopic piston 13. The output shaft of the rotary motor 254 extends out from the inside of the telescopic piston 13 and is linked with the connection support 5. The output shaft of the rotary motor 254 drives the connection support 5 into rotation. The output shaft of the rotary motor 254 is the rotation center of the connection support 5.

A positioning cylinder 15 is further fixed within the telescopic piston 13. Several positioning bores 16 are evenly distributed on the connection support 5 on the same circle using the rotation center as the center of circle. After the support finishing wheels 6 on the connection support 5 rotate to and are pressed against the inner side of the abrasive belt 4, the piston rod of the positioning cylinder 15 will extend out from the inside of the telescopic piston 13 and insert into the positioning bore 16 corresponding to the piston rod of the positioning cylinder 15 on the current connection support 5.

As shown in FIGS. 1 and 2, the abrasive belt 4 is covered on the driving wheel 2 and driven wheel 3. The driving wheel 2 rotates to drive the abrasive belt 4 into rotation therewith. When a curved surface does not have to be polished on the surface of the work piece, the connection support 5 is at a position away from the inner side of the abrasive belt 4, the first connection rod 7 and the second connection rod 9 are in a telescopic state, and the work piece is held by the manipulator in cooperation with the abrasive belt 4 of the polisher into contact with the abrasive belt 4 in rotation.

As shown in FIGS. 3 and 4, when a curved surface has to be polished on the surface of the work piece, the telescopic piston 13 within the telescopic cylinder 11 is controlled to be pushed out. The lug 18 on the side of the telescopic piston 13 slides along the chute 17 on the side of the cylinder body 12 of the telescopic cylinder 11. When the lug 18 is pressed against the end of the chute 17, the telescopic piston 13 pushes the connection support 5 to a position right on the inner side of the abrasive belt 4. In the meantime, the rim of the support finishing wheel 6 of the connection support 5 is opposite to the inner side of the abrasive belt 4. Thereafter, the support finishing wheels on the connection support 5 are selected according to the curvature of the curved surface to be polished on the surface of the work piece. The rotary motor 254 within the telescopic piston 13 is controlled to rotate. The output shaft of the rotary motor 254 drives the connection support 5 into rotation. When the support finishing wheel 6 selected on the connection support 5 is pressed against the inner side of the abrasive belt 4, the rotary motor 254 stops rotating. The support finishing wheel 6 selected on the connection support 5 forms a shape identical to the rim of the said support finishing wheel 6 on the surface of the abrasive belt 4. The work piece is held by the manipulator into contact with the abrasive belt 4 there, to polish the curved surface of a required curvature.

In order to prevent the connection support 5 from self-rotating resulted from a number of factors including collision during polishing, after the support finishing wheel 6 selected on the connection support 5 is pressed against the inner side of the abrasive belt 4, the positioning cylinder 15 within the telescopic piston 13 is controlled to work, and the piston rod of the positioning cylinder 15 extends outward and inserts into the positioning bore 16 corresponding to the piston rod of the positioning cylinder 15 on the current connection support 5, so that the connection support 5 is locked and could not rotate. Moreover, when a curved surface of a different curvature is to be polished on the surface of the work piece, the piston rod of the positioning cylinder 15 is only required to exit from the positioning bore 16 on the connection support 5. Thereafter, the support finishing wheels 6 on the connection support 5 are selected and the rotation step of the connection support 5 is repeated.

Figure 5:
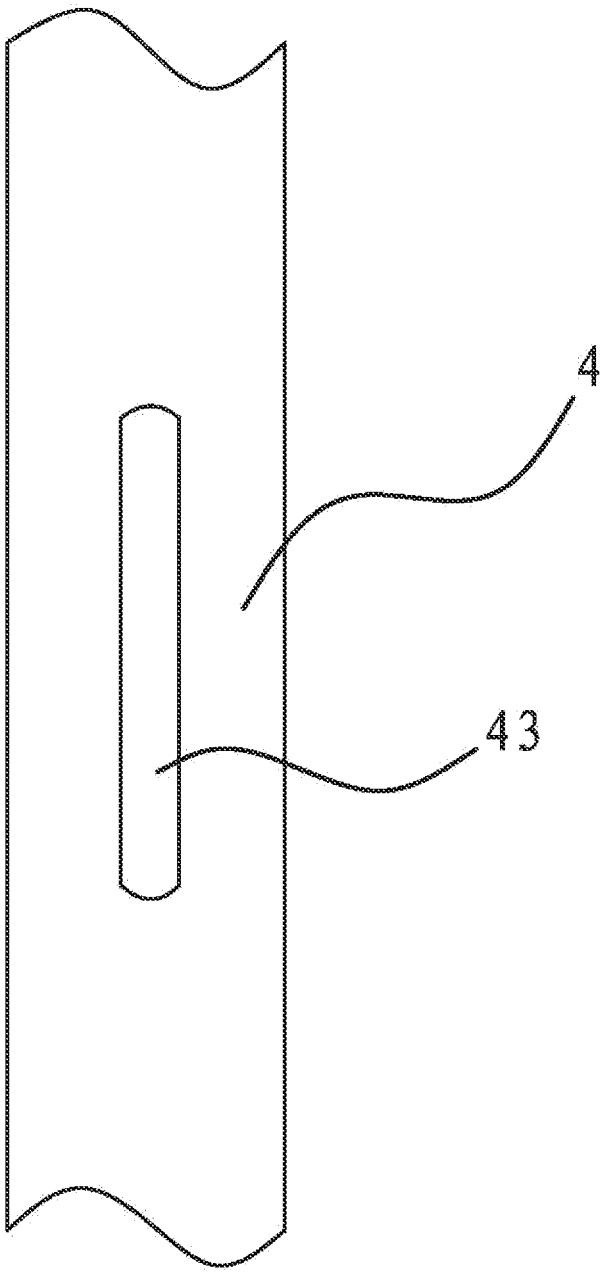
FIG. 5 is a structural diagram of the front surface of the abrasive belt when the finishing wheel of the finishing wheel transform mechanism of the abrasive belt polishing finisher of the invention is pressed against the back of the abrasive belt.

Referring to FIG. 5, when the manipulator is adjacent to the frame 1 on the inner side of the abrasive belt 4, the manipulator will collide with the connection support 5 on the inner side of the abrasive belt 4. However, when a curved surface is polished on the surface of the work piece, the piston rod of the positioning cylinder 15 is firstly controlled to be retracted, the output shaft of the rotary motor 25 then rotates to disengage the support finishing wheel 6 on the connection support 5 from the inner side of the abrasive belt 4, and then the telescopic piston 13 brings the connection support 5 to retract inward therewith. The connection support moves inward along the axis of the support finishing wheel 6 and away from the back of the abrasive belt 4, for which the frame 1 on the back of the abrasive belt 4 is hung and the manipulator will not be affected. Thereafter, in order for a curved surface to be polished on the surface of the work piece, the connection rod finishing wheel 30 on the first connection rod 7 and the second connection rod 9 could be selected according to the curvature of the curved surface. For example, when the connection rod finishing wheel 30 on the first connection rod 7 is selected, the second connection rod 9 is still in the retracted state. The piston rod of the first driving cylinder 8 is controlled to be pushed outward, and the first connection rod 7 rotates outward around the positioning post 24 under the push force until the connection rod finishing wheel 30 at the end of the first connection rod 7 is pressed against the back of the abrasive belt 4, so that the curved surface could be polished on the work piece again. As both the first connection rod 7 and the first driving cylinder 8 are disposed on the top of one side of the frame 1, even if the first connection rod 7 rotates outward until the connection rod finishing wheel 30 thereon in pressed against the back of the abrasive belt 4, the frame 1 at the back of the abrasive belt 4 is hung. Therefore, the work piece could be polished and the manipulator will not be affected.

When the connection rod finishing wheel 30 on the second connection rod 9 has to be used, the piston rod of the first driving cylinder 8 is controlled to bring the first connection rod 7 to retract therewith, the connection rod finishing wheel 30 on the first connection rod 7 is separate from the back of the abrasive belt 4, and the first connection rod 7 rotates inward and retunes to the upper part of one side of the frame 1. Then the piston rod of the second driving cylinder 10 pushes the second connection rod 9 outward to rotate outward about the hinge point. The connection rod finishing wheel 30 on the second connection rod 9 is pressed against the back of the abrasive belt 4 to polish the work piece.

The abrasive belt polisher uses the driving mechanism to move the connection support 5 along the axis of the support finishing wheel 6 thereon. When the abrasive belt polisher is not in use, a large amount of space of the frame 1 on the inner side of the abrasive belt 4 could be saved, which could ensure the frame 1 is not affected when the manipulator is close to the inner side of the abrasive belt 4, and enhance the polishing reliability of the work piece and the uniformity of the polishing precision of the work piece. The first connection rod 7 and the second connection rod 9 are respectively hinged to the upper and lower parts of one side of the frame 1. As such, a large amount of space is left at the frame 1 on the inner side of the abrasive belt 4, and in the meantime, the curved surface could polished on the work piece, thereby providing better usefulness.

Fourth Embodiment

The structure and principle of this embodiment are substantially the same as those of the third embodiment except that a housing is fixed on the side of the frame 1 opposite to the connection support 5. The driving mechanism has a spin motor fixed on the end of the housing. A via hole is provided on the side of the frame 1 corresponding to the connection support 5. A positioning sleeve having an inner cavity is threaded with the via hole. The positioning sleeve is located within the housing and the output shaft of the spin motor is connected with one end of the positioning sleeve. A rotary motor 25 is provided within the positioning sleeve. The output shaft of the rotary motor 25 extends out from the other end of the positioning sleeve and is connected with the connection support 5.

The output shaft of the spin motor is controlled to rotate forward. As the output shaft of the spin motor is linked with the positioning sleeve and the positioning sleeve is threaded with the via hole, the forward rotation of the output shaft of the spin motor will lead the positioning sleeve to extend outward along the threaded section from the inside of the housing, and lead the connection support 5 to be on the inner side of the abrasive belt 4. Thereafter, the output shaft of the rotary motor 25 is controlled to drive the connection support into rotation, so that the support finishing wheel 6 on the connection support 5 is pressed against the inner side of the abrasive belt 4. When the connection support 5 does not have to be used or the deformation of the manipulator is hindered by the connection support 5, the positioning sleeve could be retracted into the housing merely by controlling the output shaft of the spin motor to rotate anticlockwise.

Fifth Embodiment

The structure and principle of this embodiment are substantially the same as those of the third embodiment except that a housing is fixed on the side of the frame 1 opposite to the connection support 5. The driving mechanism has a spin motor fixed on the end of the housing. A via hole is provided on the side of the frame 1 corresponding to the connection support 5. A positioning sleeve having an inner cavity is threaded with the via hole. The end of the output shaft of the spin motor is fixedly connected with the first transmission gear. The positioning sleeve is located within the housing and an inner gear ring is fixed on one end of the positioning sleeve. Several second transmission gears are further provided between the first transmission gear and the inner gear ring. A rotary motor 25 is provided within the positioning sleeve. The output shaft of the rotary motor 25 extends out from the other end of the positioning sleeve and is connected with the connection support 5.

When the output shaft of the spin motor rotates forward, the first transmission gear at the end thereof drives the second transmission gears which drive the inner gear ring into rotation. As the inner gear ring is fixed at the end of the positioning sleeve, the second transmission gears drive the positioning sleeve into rotation. The positioning sleeve is threaded with the via hole on the side of the frame 1. As a result, the positioning sleeve will move in the axial direction relative to the via hole, so that the positioning sleeve is pushed outward from the inside of the housing, and the connection support 5 is located on the inner side of the abrasive belt 4. Thereafter, the rotary motor 25 within the positioning sleeve is in operation, which eventually drives the connection support 5 into rotation until the support finishing wheel 6 thereon is pressed against the inner side of the abrasive belt 4. When the connection support 5 does not have to be used or the deformation of the manipulator is hindered by the connection support 5, the positioning sleeve could be retracted into the housing merely by controlling the output shaft of the spin motor to rotate anticlockwise.

The embodiments described herein are merely illustrative of the spirit of the invention. It is obvious for those skilled in the art to make various modifications, supplements or alternatives to these embodiments without departing from the spirit of the invention or the scope as defined by the appended claims.

LIST OF REFERENCE NUMERALS

1 Frame
2 Driving Wheel
3 Driven Wheel
4 Abrasive Belt
43 Shape the same as the Finished Curved Surface
5 Connection Support
6 Support Finishing Wheel
30 Connection Rod Finishing Wheel
7 First Connection Rod
8 First Driving Cylinder
9 Second Connection Rod
10 Second Driving Cylinder
11 Telescopic Cylinder
12 Cylinder Body
13 Telescopic Piston
14 Rotary Motor
15 Positioning Cylinder
16 Positioning Bore
17 Chute
18 Lug
19 Support Post
20 Connection Block
21 Mounting Groove
22 Mounting Hole
23 Guide Groove
24 Positioning Post
25 Motor
51 Connection Part
52 Support Part
26 Body
27 Finishing Cover
28 Proximity Switch
29 Sensor Block

What is claimed is:

1. An abrasive belt polishing finisher, comprising:

a frame (1);

a driving wheel (2) and a driven wheel (3) connected to the frame (1);

an abrasive belt (4) set on the driving wheel (2) and the driven wheel (3); and a finishing wheel transform mechanism connected to the frame (1), the finishing wheel transform mechanism having a motor (25) and a connection support (5), a central portion of the connection support (5) is fixedly connected with an output shaft of the motor (25), several self-rotable support finishing wheels (6) are connected around the connection support (5);

wherein a first curvature of a first rim of a first support finishing wheel (6) is different from a second curvature of a second rim of a second support finishing wheel (6);

wherein all of the support finishing wheel (6) is wheels (6) are distributed on a same circle a same orbit centered on the output shaft of the motor (25);

wherein the connection support (5) is driven by the motor (25) into rotation when the connection support (5) is positioning one of the support finishing wheels (6) to press against a back of the abrasive belt (4);

wherein a driving mechanism is connected with the finishing wheel transform mechanism, the connection support (5) in the finishing wheel transform mechanism is capable of moving between a first position and a second position along an axial direction of the support finishing wheels (6);

wherein in the first position, the driving mechanism drives the connection support (5) to disengage the support finishing wheels (6) from the abrasive belt (4) and to move the support finishing wheels (6) out of an area surrounded by the abrasive belt (4);

wherein in the second position, the driving mechanism drives the connection support (5) to move into the area surrounded by the abrasive belt (4) and causes the support finishing wheels (6) to move toward the back of the abrasive belt (4); and wherein in the second position, one of the support finishing wheels (6) driven by the finishing wheel transform mechanism is in contact with the abrasive belt (4).

2. The abrasive belt polishing finisher as claimed in claim 1, characterized in that, the connection support (5) comprises a connection part (51) fixedly connected with an outer end of the output shaft of the motor (25) and several rod-like support parts (52) disposed in a radial direction of the output shaft of the motor (25), the number of the support parts (52) is the same as that of the support finishing wheels (6), and outer ends of the support parts (52) are respectively connected with the support finishing wheels (6) through connection pieces.

3. The abrasive belt polishing finisher as claimed in claim 2, characterized in that, the finishing wheel transform mechanism further comprises a controller and a detection module connected with the controller, the detection module is located on the motor (25) and the connection support (5) and the detection module capable of detecting that a stop signal is sent to the controller when the support finishing wheels (6) along with the connection support (5) rotate to the back of the abrasive belt (4), and the controller capable of controlling the motor (25) to stop working and be positioned after receiving the stop signal from the detection module.

4. The abrasive belt polishing finisher as claimed in claim 3, characterized in that, the detection module comprises a proximity switch (28) and sensor blocks (29) in the same number as the support finishing wheels (6) disposed outside of the motor (25), each of the sensor blocks (29) is correspondingly fixedly connected with a support post (19) connected with one of the support finishing wheels (6) and each of the sensor blocks (29) is capable of moving to a position opposite to the proximity switch (28) when it rotates to the back of the abrasive belt (4) along with the support finishing wheel (6).

5. The abrasive belt polishing finisher as claimed in claim 4, characterized in that, each of the support finishing wheels (6) comprises a wheel-like body (26) and an annular finishing cover (27) covered outside of the body (26), a back of the finishing cover (27) is fixedly connected with the body (26), and a finishing curved surface against the back of the abrasive belt (4) is provided on an outer side of the finishing cover (27).

6. The abrasive belt polishing finisher as claimed in claim 2, further comprising:

connection rod finishing wheels (30) movable between a polishing position and a reset position, the connection rod finishing wheels (30) located in the area surrounded by the abrasive belt (4);

wherein, in the polishing position, the connection support (5) moves to the first position to disengage the support finishing wheels (6) from the abrasive belt (4), and to locate the support finishing wheels (6) out of the area surrounded by the abrasive belt (4), and the connection rod finishing wheels (30) move to the back of the abrasive belt (4) and contact with the abrasive belt (4); and wherein, in the reset position, the connection rod finishing wheels (30) disengage from the back of the abrasive belt (4) to return to the area surrounded by the abrasive belt (4).

7. The abrasive belt polishing finisher as claimed in claim 6, wherein the connection rod finishing wheels (30) are located above and under the connection support (5), respectively; and wherein a contact position of the connection rod finishing wheels (30) in contact with the abrasive belt (4) after moving is identical to a contact position of the support finishing wheels (6) in contact with the abrasive belt (4) after the connection support (5) moves.

8. The abrasive belt polishing finisher as claimed in claim 7, characterized in that, a first connection rod (7) and a first driving cylinder (8) are connected on the frame (1), the first connection rod (7) and the first driving cylinder (8) are located above the connection support (5) and out of the area surrounded by the abrasive belt (4), a first end of the first connection rod (7) is hinged to the frame (1) and a second end of the first connection rod (7) is connected with the connection rod finishing wheel (30) within the area surrounded by the abrasive belt, an end of a piston rod of the first driving cylinder (8) is hinged to the first connection rod (7) and an end of a cylinder body of the first driving cylinder (8) is hinged to the frame (1).

9. The abrasive belt polishing finisher as claimed in claim 8, characterized in that, the frame (1) is connected with a second connection rod (9) and a second driving cylinder (10), the second connection rod (9) and the second driving cylinder (10) are located under the connection support (5) and out of the area surrounded by the abrasive belt (4), one end of the second connection rod (9) is hinged to the frame (1) and the other end thereof is connected with the connection rod finishing wheel (30) within the area surrounded by the abrasive belt, an end of the piston rod of the second driving cylinder (10) is hinged to the second connection rod (9), and a rim of the connection rod finishing wheel (30) on the first connection rod (7) has a curvature different from that of the connection rod finishing wheel (30) on the second connection rod (9).

10. The abrasive belt polishing finisher as claimed in claim 9, characterized in that, the connection support (5) is located at a central portion of the frame (1), the driving mechanism comprises a telescopic cylinder (11) on the frame (1), a cylinder body (12) of the telescopic cylinder (11) is fixed on the frame (11), a telescopic piston (13) is connected within the telescopic cylinder (11), and the telescopic piston (13) passes through a side of the frame (1) and is linked with the connection support (5).

11. The abrasive belt polishing finisher as claimed in claim 10, characterized in that, the cylinder body (12) of the telescopic cylinder (11) and the telescopic piston (13) are both cylindrical, the telescopic piston (13) has an inner cavity, a rotary motor (14) is fixed within the telescopic piston (13) and an output shaft of the rotary motor (14) extends out from an inside of the telescopic piston (13) and is connected with the connection support (5).

12. The abrasive belt polishing finisher as claimed in claim 11, characterized in that, a positioning cylinder (15) is further fixed within the telescopic piston (13), several positioning bores (16) are evenly distributed on the connection support (5) on the same circle using a rotation center thereof as a center of circle, and a piston rod of the aid positioning cylinder (15) capable of extending out from the inside of the telescopic piston (13) and insert into the positioning bores (16).

13. The abrasive belt polishing finisher as claimed in claim 12, characterized in that, the cylinder body (12) of the telescopic cylinder (11) has a chute (17) opened from an end to a middle on its side, a side of the telescopic piston (13) is connected with a lug (18) which capable of sliding along the chute (17), the lug (18) is located within the chute (17) and a portion of the lug (18) extends out of the chute (17), and when the lug (18) is pressed against the end of the chute (17), the connection support (5) is located at the back of the abrasive belt (4).

14. The abrasive belt polishing finisher as claimed in claim 9, characterized in that, a housing is fixed on a side of the frame (1) opposite to the connection support (5), the driving mechanism has a spin motor fixed on an end of the housing, a via hole is provided on the side of the frame (1) corresponding to the connection support (5), a positioning sleeve having an inner cavity is threaded with the via hole, the positioning sleeve is located within the housing and an output shaft of the spin motor is connected with one end of the positioning sleeve, the rotary motor (14) is provided within the positioning sleeve, and the output shaft of the rotary motor (14) extends out from the other end of the positioning sleeve and is connected with the connection support (5).

15. The abrasive belt polishing finisher as claimed in claim 9, characterized in that, a housing is fixed on a side of the frame (1) opposite to the connection support (5), the driving mechanism has a spin motor fixed on an end of the housing, a via hole is provided on the side of the frame (1) corresponding to the connection support (5), a positioning sleeve having an inner cavity is threaded with the via hole, an end of an output shaft of the spin motor is fixedly connected with a first transmission gear, the positioning sleeve is located within the housing and an inner gear ring is fixed on one end of the positioning sleeve, several second transmission gears are further provided between the first transmission gear and the inner gear ring, the rotary motor (14) is provided within the positioning sleeve, and an output shaft of the rotary motor (14) extends out from the other end of the positioning sleeve and is connected with the connection support (5).

16. The abrasive belt polishing finisher as claimed in claim 13, characterized in that, the connection support (5) is of a round-disk shape, connection blocks (20) of a Z-shape are disposed on the connection support (5), bottoms of the connection blocks (20) are fixed on the connection support (5) and the support finishing wheels (6) are connected with upper parts of the connection blocks (20).

17. The abrasive belt polishing finisher as claimed in claim 16, characterized in that, elongated mounting grooves (21) are opened through a bottom of the connection block (20), several support posts (19) which are arranged in a radial direction of the connection support (5) and integrated with the connection support (5) are provided at an edge of the connection support (5), several mounting holes (22) in a linear arrangement are correspondingly provided on the support post (19) and the connection support (5), and the connection blocks (20) are linked with the support posts (19) through fasteners capable of passing through the mounting grooves (21) and capable of inserting into the mounting holes (22).

18. The abrasive belt polishing finisher as claimed in claim 17, characterized in that, a convex guide strip is disposed at the bottom of the connection block (20) and a guide groove (23) is correspondingly opened on the support post (19) of the connection support (5).

* * * * *